United States Patent [19]

Albulescu et al.

[11] 4,119,349

[45] Oct. 10, 1978

[54] METHOD AND APPARATUS FOR RECOVERY OF FLUIDS PRODUCED IN IN-SITU RETORTING OF OIL SHALE

[75] Inventors: Peter Albulescu, Caldwell; Joseph F. McMahon, Clinton, both of N.J.

[73] Assignees: Gulf Oil Corporation, Pittsburgh, Pa.; Standard Oil Company (Indiana), Chicago, Ill.

[21] Appl. No.: 844,629

[22] Filed: Oct. 25, 1977

[51] Int. Cl.[2] ..... E21B 43/24; E21C 41/10

[52] U.S. Cl. ..... 299/2; 166/265

[58] Field of Search ..... 166/265, 267; 208/11 R; 210/73 W, 170, 540; 299/2

[56] References Cited

U.S. PATENT DOCUMENTS

| | | | |
|---|---|---|---|
| 1,269,747 | 6/1918 | Rogers | 299/2 |
| 1,496,090 | 6/1924 | Marker et al. | 210/170 |
| 1,716,667 | 6/1929 | Schillng | 208/11 R X |
| 1,722,679 | 7/1929 | Ranney | 299/2 |
| 2,341,359 | 2/1944 | Buckley | 166/265 X |
| 2,481,051 | 9/1949 | Uren | 166/302 |
| 2,774,726 | 12/1956 | Eichna | 208/11 R X |
| 2,986,279 | 5/1961 | Henigman | 210/73 W |
| 3,384,569 | 5/1968 | Peet | 208/11 R |
| 4,014,575 | 3/1977 | French et al. | 166/267 X |

*Primary Examiner*—Stephen J. Novosad
*Assistant Examiner*—George A. Suchfield

[57] ABSTRACT

Gaseous and liquid products discharged from the outlet of an in-situ retort for the retorting of oil shale are delivered into an underground separating chamber located substantially at the level of the bottom of the retort. The lower portion of the separating chamber is divided by a weir into a first sump adjacent the inlet end of the separating chamber and a second sump adjacent the outlet end of the separating chamber. Oil and water separate in the first sump and the oil overflows the weir into the second sump. Water is withdrawn at a level below the oil in the first sump and pumped to the surface. Oil is withdrawn from the second sump and pumped to the surface separately from the water.

9 Claims, 2 Drawing Figures

10
12
14
16
18
20
22
22a
22b
24
26
28
28a
28b
30
30a
30b
32
34
36
38
40
42
44
46
48
50
52
54
P

METHOD AND APPARATUS FOR RECOVERY OF FLUIDS PRODUCED IN IN-SITU RETORTING OF OIL SHALE

BACKGROUND OF THE INVENTION

1. Field of the Invention

This invention relates to the production of shale oil and more particularly to the in-situ retorting of oil shale to produce shale oil and the delivery of products from the retort to the surface.

2. Description of the Prior Art

A process that has been developed for the production of shale oil from oil shale is known as the in-situ retorting process. In that process, a retort filled with rubblized oil shale is constructed in the underground oil shale formation. The rubblized shale is heated to a temperature above about 88° F. to produce shale oil from kerogen, a carbonaceous constituent in oil shale. In a preferred process for in-situ retorting, rubblized shale at the top of the in-situ retort is ignited by the burning of a fuel gas at the upper end of the retort and thereafter delivery of the fuel gas is terminated while injection of an oxygen-containing gas, usually air, into the upper end of the formation is continued to continue burning of carbonaceous material in the shale. Hot products of combustion pass downwardly through the shale to heat shale below the combustion front to a temperature at which kerogen is converted to shale oil. The gaseous products of combustion, the shale oil, and water resulting from the combustion or from leakage into the retort from aquifers are discharged from the bottom of the retort and delivered to the surface. Typical in-situ combustion processes for the production of shale oil are described in U.S. Pat. No. 1,919,636 of Karrick, U.S. Pat. No. 2,481,051 of Uren and U.S. Pat. No. 3,001,776 of Van Poollen.

The products discharged from the lower end of the retort are a mixture of carbon dioxide, air, carbon monoxide, water and some partially oxidized organic compounds. The complex mixture promotes the formation of an emulsion of the shale oil and water that is difficult to break. In U.S. Pat. No. 4,014,575 of French et al., a process is described for handling the products from an in-situ combustion retort in which liquids discharged from the retort are separated from the gaseous products and pumped from an underground sump to a separator at the surface. The intense mixing of the shale oil with aqueous liquids in the pump and the pipeline to the surface can aggravate the formation of emulsions.

SUMMARY OF THE INVENTION

This invention resides in a method and apparatus for the delivery of products from an in-situ retort for the production of shale oil in which products discharged from the retort are delivered into a large separating chamber at the level of the bottom of the retort. The lower part of the chamber is divided into a first sump adjacent the inlet and a second sump adjacent the outlet by a weir. Liquids discharged from the retort and condensing or settling from the gaseous products of the in-situ retorting collect in the first sump and separate into an oil phase and an aqueous phase. The oil phase overflows the weir into the second sump. The aqueous phase and the oil phase are pumped separately to the surface.

DESCRIPTION OF PREFERRED EMBODIMENT

Figures 1, 2:
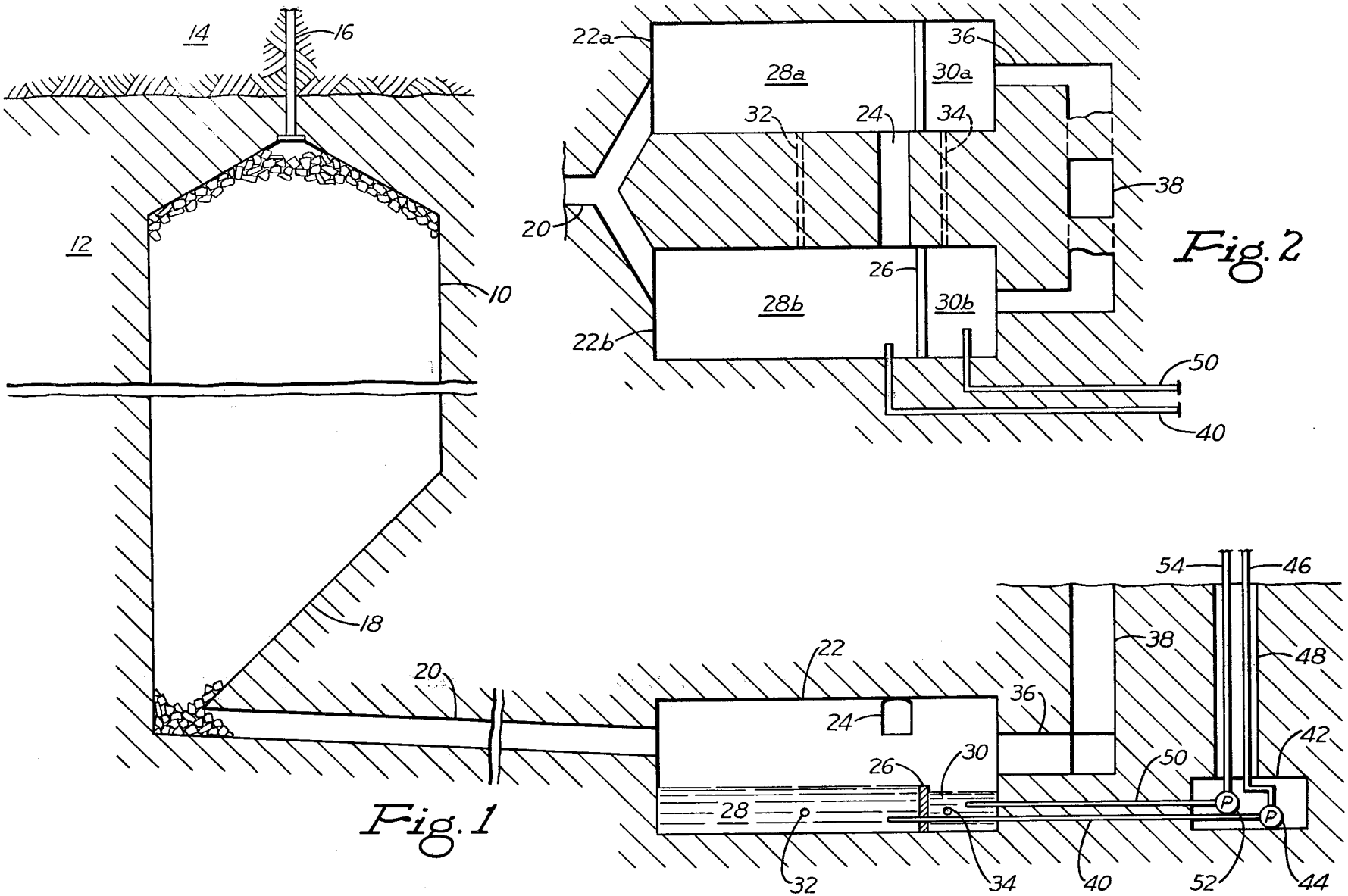
FIG. 1 is a diagrammatic vertical sectional view of an in-situ retort and the structure for delivery of products from the retort to the surface.
FIG. 2 is a plan view of a preferred arrangement of the chamber for the separation of the products from the retort.

Referring to FIG. 1, an in-situ retort 10 filled with rubblized shale is shown in an underground shale formation 12 underlying overburden 14. An air inlet passage 16 from compressors, not shown, at the ground surface opens into the upper end of retort 10. Retort 10 has a sloping bottom 18 that communicates at its lower end with a production drift 20.

Production drift 20 preferably slopes downwardly from the bottom of retort 10 slightly to faciliate drainage of liquid products from the in-situ retort 10. Drift 20 opens at its end remote from the retort 10 into an enlarged separating chamber 22. Separating chamber 22 is located in the shale formation such that liquids from retort 10 will flow readily from the retort to the chamber. In the preferred embodiment of the invention illustrated in FIG. 2 separating chamber 22 comprises two parallel chambers designated in FIG. 2 as **22*a* and 22*b* cross connected by an equalizing passage 24 joining the gas space in the two chambers. The parallel construction base illustrated in FIG. 2 provides a large cross-sectional area perpendicular to the direction of flow through the separator without exceeding the maximum span of the underground formation that is self-supporting. Typically, for an in-situ retort having a width of 100 feet and a length of 300 feet, each of the chambers would have approximate dimensions of 200 feet long, 40 feet wide and 100 feet high. The size of the separating chamber 22 will depend on the size of the retort 10 and the rate at which the combustion front is made to move through the retort. The cross-section areas of the separating chambers 22** perpendicular to the direction of flow should be such that the velocity of the gases is less than about 20 feet per second and preferably less than 5 feet per second.

Extending upwardly from the bottom of the chamber, preferably near its discharge end, is a wier 26 that divides the lower portion of the chamber into a first sump 28 and a second sump 30. In FIG. 2, the first sumps are designated **28*a* and 28*b*, and the second sumps, 30*a* and 30*b*. Weir 26 may have a height of approximately 25 feet and be positioned 120 feet from the inlet end of the chamber in the typical separating chambers described above. As best shown in FIG. 2, sumps 28*a* and 28*b* are connected by an equalizing line 32. Sumps 30*a* and 30*b* are connected by an equalizing line 34. Sump 28, whether a single sump or in the form of a plurality of sumps in parallel, should have a volume adequate to provide a residence time that will accomplish the desired separation of the shale oil from aqueous liquids produced in the retorting. The residence time should be in the range of 4 to 48 hours. A residence time of approximately 20 hours is preferred. The horizontal cross-sectional area of sump 28 should be such that the upward velocity of the shale oil should not exceed 1 foot per hour, and preferably does not exceed 1 foot per hour, and preferably does not exceed about 0.4 foot per hour. The size of sump 30** is not critical as it serves principally as a hold tank for the shale oil to feed a pump that delivers the shale oil to the surface.

A delivery tunnel 36 extends from the discharge end of the chamber 22 to a vertical gaseous products delivery shaft 38 that extends upwardly to the surface. Shaft 38 preferably has smooth, connected walls and serves as a duct through which gaseous products flow to the surface.

An aqueous liquids pipe 40 extends from the sump 28 to a pump room 42 in which pipe 40 is connected to the inlet of a pump 44. The discharge line 46 from the pump extends upwardly to the ground surface through a liquid products shaft 48. An oil delivery pipe 50 extends from sump 30 to pump room 42 in which pipe 50 is connected to the inlet of a pump 52. Discharge line 54 from pump 52 extends upwardly to the surface through liquid products shaft 48. Sump 28 is provided with means, not shown, for regulating the level of the aqueous liquid-oil interface by controlling the pumping of oil from the sump. Similarly, a liquid level control, not shown, in sump 30 controls operation of pump 52.

In operation, air is delivered into the upper end of the retort 10, the shale is ignited, and downward burning is conducted in retort 10 to supply the heat necessary for conversion of kerogen to shale oil. Shale oil and the products of combustion flow downwardly through the rubblized shale in the retort into the production drift 20 and into the separating chamber 22. The enlarged cross-sectional area of the separating chamber 22 relative to drift 20 reduces the velocity of the gases and results in settling of liquids from gaseous products of combustion. The liquids disengaged from the gases in chamber 22 and discharged from the retort 10 collect principally in the first sump 28. Aqueous liquids in the lower portion of the first sump 28 are pumped from the sump through lines 40 and 46 to the surface. Shale oil is separated from the aqueous liquids in the first sump and overlows the weir 26 into the second sump. The oil is picked up through line 50 by pump 52 and delivered to the surface through line 54. If the water content of the oil delivered through line 48 should increase, the rate of pumping from the first sump is increased to prevent flow of water over weir 26. Gases flow from the separating chamber 22 through tunnel 36 to vertical shaft 38.

The apparatus and method of this invention minimize formation of difficult to separate emulsions of aqueous liquid and shale oil. The location of the separating chamber at the level of the bottom of the retort results in the delivery of liquids into the first sump at a high temperature that favors separation of the shale oil and aqueous liquids. The large volume of the separating chamber, particularly in the preferred embodiment best illustrated in FIG. 2, reduces the velocity of gases to improve disengagement of droplets of liquids from the gases.

The weirs will generally have a height of approximately 25 feet to form sumps of large volume to give adequate time for the liquids at the high temperature to separate into an oil phase and an aqueous liquids phase. The low rate of heat loss to the formation surrounding the chambers as compared to heat loss to the atmosphere in a surface separator results in the shale oil retaining its high temperature and low viscosity that favors rapid and effective separation. The separate delivery of the oil and the aqueous phase to the surface avoids the vigorous mixing that encourages emulsification that occurs on delivering the liquid products of retorting through a single delivery line.

We claim:

1. A method for the recovery of products from the retorting of oil shale in an in-situ retort comprising:

(a) passing products from the retort through a production drift into an underground separator of large cross section located no higher than the lower end of the retort;

(b) delivering liquids entering the separating chamber from the production drift into a first sump adjacent the inlet end of the separating chamber;

(c) decanting shale oil from the first sump into a second sump;

(d) discharging gases from the end of the separating chamber remote from the production drift and delivering said gases through a shaft to the surface;

(e) withdrawing aqueous liquids from the first sump and pumping said liquids to the surface; and (f) withdrawing shale oil from the second sump and pumping said shale oil separately from the aqueous liquids to the surface.

2. A method as set forth in claim 1 in which the decanting is accomplished by flowing the shale oil over a weir separating the first sump and the second sump.

3. A method as set forth in claim 1 characterized by:

(a) gas and liquid products flowing through the production drift being divided into a plurality of streams, (b) each of the streams being delivered into a separate separating chamber;

(c) each of the separating streams being divided into a first sump and second sump, and (d) separately pumping to the surface aqueous fluids from the first sump of the separating chambers and shale oil from the second sump of the separating chambers.

4. Apparatus for the delivery of products discharged from an in-situ retort for the retorting of oil shale comprising:

(a) an underground separating chamber at substantially the level of the bottom of the in-situ retort;

(b) a production drift from the lower end of the in-situ retort to the inlet end of the separating chamber;

(c) a first sump in the separating chamber adjacent the inlet end thereof;

(d) a second sump in the separating chamber adjacent the outlet end thereof;

(e) a weir separating the first sump and second sump;

(f) a duct opening into the separating chamber at the outlet end thereof and extending upwardly to the surface for the delivery of gases;

(g) aqueous liquid pumping means adapted to withdraw aqueous liquids from below the liquid surface in the first sump and deliver the aqueous liquids to surface; and (h) oil pumping means constructed and arranged to withdraw shale oil from the second sump and deliver it separately from the aqueous liquids to the surface.

5. Apparatus as set forth in claim 4 in which the production drift slopes downwardly from the bottom of the in-situ retort to the separating chamber.

6. Apparatus as set forth in claim 4 in which the first sump has a volume adapted to provide a residence of 4 to 48 hours for liquids delivered thereto.

7. Apparatus as set forth in claim 4 characterized by the separating chamber having a cross-section area perpendicular to the direction of flow therethrough adapted to reduce the velocity of gases flowing therethrough to below 20 feet per second.

8. Apparatus for collecting and delivering to the surface products from an in-situ retort for the retorting of oil shale to produce shale oil comprising:

(a) a production drift extending laterally from an outlet at the lower end of the in-situ retort;

(b) said drift being divided at its end remote from the in-situ retort into a plurality of passages (c) a plurality of separating chambers, each of said separating chambers being connected to one of the passages whereby the separating chambers operate in parallel;

(d) each separating chamber having a first sump adjacent the inlet end thereof and a second sump adjacent the end thereof remote from the passages;

(e) a weir in each of the separating chambers separating the first sump from the second sump;

(f) an outlet tunnel communicating with each of the separating chambers;

(g) duct means in the outlet tunnel adapted to deliver gases from the separating chambers to the surface;

(h) aqueous liquid pumping means adapted to withdraw aqueous liquid from the first sump in the separating chambers below the liquid level therein and pump the aqueous liquid to the surface; and (i) shale oil pumping means adapted to withdraw oil from the second sumps and deliver the oil separately from the aqueous liquids to the surface.

9. Apparatus as set forth in claim 8 characterized by the chambers having a width and a height adapted to redue the velocity of offgases from the retort to below 20 feet per second, and the first sumps having a volume and horizontal cross section adapted to give a residence time of liquids therein of 4 to 48 hours an an upward velocity of shale oil therein of less than 1 foot per hour.

* * * * *

UNITED STATES PATENT AND TRADEMARK OFFICE

CERTIFICATE OF CORRECTION

PATENT NO. : 4,119,349

DATED : October 10, 1978

INVENTOR(S) : Peter Albulescu and Joseph F. McMahon

It is certified that error appears in the above-identified patent and that said Letters Patent are hereby corrected as shown below:

Column 6, line 14, "redue" should be --reduce--.

Column 6, line 17, "an", first occurrence, should be --and--.

Signed and Sealed this

*Second* Day of *January 1979*

[SEAL]

*Attest:*

RUTH C. MASON
*Attesting Officer*

DONALD W. BANNER
*Commissioner of Patents and Trademarks*